US005232164A

United States Patent [19]

Resch et al.

[11] Patent Number: 5,232,164

[45] Date of Patent: Aug. 3, 1993

[54] PRECISELY ADJUSTABLE ATOMIZER

[76] Inventors: Darrel R. Resch, 710 Brookside Rd., Maitland, Fla. 32751; Murray K. Lemons, 805 Helmock Dr., Apopka, Fla. 32712; Elisha W. Erb, 94 Harvard St., Leominster, Mass. 01453

[21] Appl. No.: 844,529

[22] Filed: Mar. 2, 1992

Related U.S. Application Data

[63] Continuation-in-part of Ser. No. 521,280, May 9, 1990, abandoned.

[51] Int. Cl.[5] ..... B05B 17/04

[52] U.S. Cl. ..... 239/434; 239/424; 239/426; 261/DIG. 39; 261/78.1; 261/78.2; 261/62; 261/44.5

[58] Field of Search ..... 239/433, 434, 418, 424, 239/426; 261/DIG. 39, 78.1, 78.2, 44.5, 62

[56] References Cited

U.S. PATENT DOCUMENTS

| | | | |
|---|---|---|---|
| 1,038,804 | 9/1912 | Warren | 261/DIG. 39 |
| 1,394,452 | 10/1921 | Taft | 261/78.1 |
| 1,436,351 | 11/1922 | Metcalfe . | |
| 2,719,056 | 9/1955 | Bettison | 239/434 |
| 3,240,254 | 3/1956 | Hughes | 239/434 |
| 3,993,246 | 11/1976 | Erb et al. . | |
| 4,018,387 | 4/1977 | Erb et al. . | |
| 4,161,281 | 7/1979 | Erb et al. . | |
| 4,161,282 | 7/1979 | Erb et al. . | |
| 4,261,511 | 4/1981 | Erb et al. . | |
| 4,284,590 | 8/1981 | Deboer, Jr. et al. | 239/434 |

FOREIGN PATENT DOCUMENTS

| | | | |
|---|---|---|---|
| 450583 | 8/1948 | Canada | 239/426 |
| 244204 | 4/1987 | European Pat. Off. | 239/434 |
| 1147042 | 9/1970 | Fed. Rep. of Germany | 239/434 |
| 1152 | 6/1912 | United Kingdom | 239/434 |

*Primary Examiner*—Andres Kashnikow
*Assistant Examiner*—Christopher G. Trainor
*Attorney, Agent, or Firm*—Julian C. Renfro

[57] ABSTRACT

An atomizer device comprising a body member having a gas nozzle defined by smooth converging sidewalls. A first smooth surface is disposed in a substantially perpendicular relationship to the nozzle, and a second smooth surface is disposed in an abutting parallel relationship with the first smooth surface, with a very small spacing existing between the two surfaces. An edge of the surfaces is disposed adjacent a propellant gas flowing through the gas nozzle, with the edge of the first surface being thin and jutting a short distance into the outlet of the gas nozzle. The edge of the second surface is set back from the edge of the first surface, thus defining a filming surface adjacent the edge of the first surface. A flowable liquid under pressure is directed to flow through the narrow space between the abutting first and second surfaces, toward the flow of propellant gas through the nozzle, and emit as a thin film on the filming surface on the first surface. The propellant gas flowing through the nozzle is caused by the jutting edge of the first surface to be slightly separated from the thin edge of the first surface at the filming surface. This slight separation does not prevent the entrainment into the gas of ribbons of liquid from the filming surface, which liquid breaks up into extremely small particles in the propellant gas flow.

15 Claims, 5 Drawing Sheets

PRECISELY ADJUSTABLE ATOMIZER

RELATIONSHIP TO PREVIOUS INVENTION

This is a Continuation-in-Part of our Co-pending application "Precisely Adjustable Atomizer," Ser. No. 07/521,280, filed May 9, 1990, which is to be abandoned with the filing of this application.

BACKGROUND OF THE INVENTION

In general, prior known pneumatic atomizer and nebulizer devices are based upon a principle in accordance with which a propellant gas is forced through a narrow orifice into contact with a thin film or stream of liquid which is fed to the periphery or outlet of the orifice. At this location the thin film or stream of liquid is entrained in the propellant gas flowing out of the orifice and broken into droplets, which are carried away by the flowing gas.

Such known pneumatic nebulizers and atomizers have several disadvantages. Most such nebulizers are not effective in emitting a fog of liquid particles which is both dense and composed of fine liquid particles when operated with the propellant gas at pressures less than about 5 p.s.i. If the propellant gas is at a pressure less than about 5 p.s.i., either the fog emitted by the pneumatic atomizer will be thin, or the liquid particles within the fog will be large, depending on the design of the pneumatic atomizer and on the amount of liquid supplied to the pneumatic atomizer. If the propellant gas pressure is less than 5 p.s.i., and the amount of liquid supplied to the pneumatic atomizer is not sharply reduced, the liquid particles in the emitted fog will be unacceptably large, with resulting fall-out of liquid from the emitted fog.

The foregoing difficulties are partly ameliorated in some pneumatic atomizers designed for low pressure propellant gas by placing an impactor, shroud or other barrier in the path of the emitted fog to separate out those liquid particles having particle sizes above about 50 microns. Such known pneumatic nebulizers cannot directly produce a fog having dispersed liquid particles have a maximum diameter of 20 microns or less.

If the fog contains liquid particles larger than about 20 microns in diameter, the larger liquid particles in the fog will strike the impactor and wet its surface, whereas the smaller particles in the fog will be carried around the impactor by the propellant gas and will not wet the impactor's surface. The difficulty with placing an impactor or other barrier in the path of the emitted fog to capture larger particles in the emitted fog is that a means must be provided to collect the liquid that comes into contact with the impactor or barrier, and a means must be provided to recirculate the collected liquid or otherwise dispose of the collected liquid.

The relevant patents are the Metcalf Patent No. 1,436,351 entitled "Fuel Nozzle," which issued Nov. 21, 1922; the Erb and Resch Patent No. 3,993,246 entitled "Nebulizer and Method," which issued Nov. 23, 1976; and the Erb and Resch Patent No. 4,018,387 issuing Apr. 19, 1977 and entitled "Nebulizer," which is a division of the immediately preceding patent. Other relevant patents are the Erb and Resch Patent No. 4,161,281 entitled "Pneumatic Nebulizer and Method," issued Jul. 17, 1979; the Erb and Resch Patent No 4,161,482 entitled "Microcapillary Nebulizer and Method," also issued on Jul. 17, 1979; and the Erb and Resch Patent No. 4,261,511, entitled "Nebulizer and Method," which issued Apr. 14, 1981.

The devices covered by the foregoing patents may be regarded as comprising the following elements:

1) A surface on which the liquid to be atomized is spread, resulting in a film of the liquid on the surface;

2)One or more orifices that pass through the filming surface; and

3) A means for supplying gas to the under (back) side of the filming surface, such gas being at a greater pressure upstream of the filming surface than the ambient gas above the filming surface.

It is important to note in this context that the pressure of the gas upstream of the filming surface may be at atmospheric pressure if the ambient pressure over the filming surface is at a vacuum, as is the case in an internal combustion engine intake manifold. The consequential point is that there be a pressure drop between a point upstream of the filming surface and the front side of the filming surface to cause the gas to flow from such point, through the orifices in the filming surface, to the front side of the filming surface. This drop in pressure is called the pressure head.

In operation, gas flowing through the orifices in the filming surface entrains liquid drawn from the liquid film on the filming surface, which entrained liquid is drawn into ribbons, which ribbons break into shreds, which shreds collapse into droplets. The droplets are then carried off by the flowing gas.

To generate fine liquid particles, (i) the liquid film must be as thin as possible where it meets the flowing gas; (ii) the conditions where the liquid film and flowing gas meet should be such as to encourage the liquid in the liquid film being entrained in the flowing gas as thin ribbons of liquid; and (iii) the flowing gas should be moving at the point where it encounters the liquid with the highest velocity obtainable with the available pressure head.

The prior art, such as the patent to Metcalfe, U.S. Pat. No. 1,436,351 and the Erb and Resch U.S. Pat. Nos. 4,161,281 and 4,161,282 teach various means and devices for making a thin liquid film on a filming surface that has one or more orifices through the filming surface. The prior art does not teach designing the atomizer to enhance the entrainment of the liquid into the flowing gas as thin ribbons of liquid, nor does the prior art teach designing the atomizer to maximize the velocity of the gas flow at the point where the flowing gas encounters the liquid. Significantly, the prior art does not teach a nozzle defined by a smooth converging surface or duct which guides the flowing gas from a large cross-sectional area conduit to the underside of the filming surface, the outlet of the nozzle almost matching the shape and cross-sectional area of the orifice through the filming surface.

Most importantly, the prior art does not teach the utilization of a sharp edge orifice in the filming surface through which the flowing gas passes, which orifice is slightly smaller in cross-sectional area than the outlet of the nozzle, with a short gap or separation being created between the sharp edge of the orifice and the location where the flow of gas through the orifice comes into contact with the liquid entrained from the filming surface.

An examination of the prior art discloses the pressurized gas used to operate the pneumatic atomizer is supplied by means of a conduit that directs the pressured gas to a chamber within the pneumatic atomizer. This chamber is hereinafter called the "the gas chamber." The gas chamber has one or more orifices passing through a wall of the gas chamber to the exterior of the atomizer. Such orifices are hereinafter called "the gas orifice." The exterior surface of such wall serves as a filming surface on which is located the liquid to be atomized. The liquid to be atomized is directed onto the filming surface as a thin film, which film extends around the periphery of the gas orifice.

The inner wall of the gas chamber near and about the inner edge of each gas orifice is approximately perpendicular to the centerline of the gas orifice. Stated in other words, the width of the gas chamber measured at the inner edge of the gas orifice is substantially greater than the width of the gas orifice. This means the pressurized gas passes from a space of relatively large width to a space of relatively small width as the pressurized gas passes from the gas chamber into the gas orifice. It also means the transition occurs suddenly. The sudden transition is due to the approximately right angle relationship between the sidewall of the gas orifice and the inner adjoining wall of the gas chamber.

The approximately right angle relationship of the sidewall of the gas orifice and the adjoining inner wall of the gas chamber is hereinafter called a "sharp edge." The gas orifice's sharp inner edge and the laws of fluid dynamics applicable to the flow of a pressurized gas flowing from a large container through a small sharp edged orifice in the wall of the container results in the gas exiting the gas orifice with a velocity that is not constant across the width of the gas orifice.

The gas flowing through the center of the gas orifice will have the fastest velocity, whereas the gas flowing through the gas orifice near the periphery of the gas orifice will have the slowest velocity. The difference in velocity can be substantial.

With continuing reference to the prior pneumatic atomizer art, the fact that the gas flowing near the edge of a gas orifice has a much slower velocity than the gas flowing near the center of the gas orifice, has a very detrimental effect on the pneumatic atomizer's ability to atomize the liquid film on the filming surface.

It is important to realize that it is the gas near the periphery of the gas orifice that encounters the liquid film about the periphery of the outlet of the gas orifice; entrains the liquid film; draws the liquid film into ribbons that break into droplets; and then carries the droplets off. It clearly is not the gas flowing through the center of the gas orifice that entrains the liquid.

It is also a fact that the gas near the periphery of the gas orifice is not able to atomize into fine particles as much liquid as the gas could if the gas near the periphery of the gas orifice were flowing at the higher velocity of the gas to be found in the center of the gas orifice.

It is therefore a very important object of this invention to provide a highly advantageous pneumatic atomizer configured to cause the velocity of the gas flowing near the periphery of the gas orifice to be almost the same as the velocity of the gas near the center of the gas orifice.

SUMMARY OF THE INVENTION

As will be made clear as the description proceeds, we have evolved an advantageous configuration in accordance with which, the speed of the gas flowing near the periphery of the gas orifice is almost the same as the velocity of the gas flowing through the center of the gas orifice by directing the gas supply conduit into a smooth converging surface or a duct of sufficient length that the gas flowing through it exits the duct with uniform velocity (i.e. a nozzle) having a downstream outlet that closely matches the shape and cross-sectional area of the gas orifice. The nozzle's output immediately flows through a gas orifice disposed at the filming surface, and the velocity of the gas flowing near the periphery of the gas orifice will, quite advantageously, be almost identical to the velocity of the gas flowing through the center of the gas orifice.

By either (A) making the gas supply conduit of relatively large cross-sectional area and directing the gas supply conduit into a smooth converging surface that has a downstream outlet matching the shape and cross-sectional area of the gas orifice in the filming surface, or (B) directing the gas supply through a duct of sufficient length that the gas flowing through it exits with uniform velocity, we have found that the liquid on the filming surface is entrained into gas flowing at a much higher velocity than the liquid experiences when the gas orifice in the filming surface forms an approximately right angle with the interior wall of a relatively wide upstream gas chamber. As a consequence, it would seem that the size of the output liquid particles would be smaller. We have found that, quite unfortunately, they are not. Rather, the output liquid particles are not smaller in an instance in which a nozzle is used to cause the gas to pass directly through an orifice through the filming surface, because such arrangement has a drastic counter-productive effect on the liquid film on the filming surface.

One of the consequences of passing a gas through a sharp edge orifice is that the sharp edge causes the envelope of the fluid flow to constrict to a cross-sectional area less than the cross-sectional area of the orifice for some distance downstream in the fluid's flow. This reduction in cross-sectional area is referred to in fluid dynamics texts as the "vena contracta." When this phenomenon is present, the gas flowing through a sharp edged gas orifice will not come in contact with the sides of the gas orifice for some distance downstream.

We have found the deliberate creation of the vena contracta to be advantageous, and as a matter of fact, if the vena contracta is totally eliminated, (i.e. the sharp edge at the entrance of the gas orifice is not utilized) the gas flowing out of the gas orifice will come into contact with the liquid while the liquid is on the filming surface and cause such liquid to form a rolling wave or ridge on the filming surface around the perimeter of the gas orifice. As the liquid is no longer a thin film at the edge of the gas orifice, the liquid is, quite undesirably, entrained into the flowing gas in globs. The resulting particles are, most unfortunately, of large size.

In the instant Atomizer, the cross-sectional area and shape of the orifice through the filming surface is deliberately made slightly smaller than the cross-sectional area and shape of the outlet at the upstream end of the smooth sided gas supply nozzle, thereby creating a small, abrupt sharp edge projection or jut into the gas flow.

Applying the foregoing to the instant Atomizer—if the sides of the sharp edged orifice are sufficiently short (i.e. the filming surface is sufficiently thin), the gas flowing through the orifice will not be in contact with the outlet edge of the gas orifice as the gas exits the downstream end of the gas orifice.

Because the gas exiting the filming surface side of the orifice is thus not in direct contact with the sides of the orifice, the gas does not come into touching contact with the liquid on the filming surface, and therefore does not have the opportunity to cause such liquid to form a rolling wave or ridge around the edge of the orifice, and to be entrained as large particles or globs into the flowing gas.

In accordance with this invention, therefore, the only liquid the flowing gas comes into contact with is ribbons of liquid that have already left the filming surface to become entrained in the gas flow. Because the flowing gas thus does not come into contact with the liquid on the filming surface, the flowing gas will entrain the liquid only as thin ribbons of liquid which break into shreds which collapse into particles of exceedingly small size.

The attributes of the instant Atomizer not possessed by the prior art are as follows:

1) A nozzle defined by a smooth converging surface, which nozzle guides the flowing gas from a large cross-sectional area conduit to the underside of the filming surface, the outlet of the nozzle almost matching the shape and cross-sectional area of the orifice through the filming surface;

2) A sharp edged orifice utilized in the filming surface through which the flowing gas passes, which orifice is slightly smaller in cross-sectional area than the outlet of the nozzle; and 3) The creation of a short gap or separation between the sharp edge of the orifice and the location where the flow of gas through the orifice comes into contact with the liquid entrained from the filming surface.

From the foregoing it is to be seen that in accordance with this invention, we have provided an atomizer device capable of reducing a flowable liquid to an ultrafine dispersion of liquid particles in a propellant gas. Our novel device comprises a body member having a gas nozzle defined by converging sidewalls or defined by a duct terminating in a first of two superposed smooth surfaces. The first smooth surface is disposed in a substantially perpendicular relationship to the nozzle, and the second smooth surface is disposed in an abutting parallel relationship with the first smooth surface, with a very small spacing existing between the first and second surfaces.

A narrow edge of each of the surfaces is disposed adjacent the propellant gas flowing through the gas nozzle, with such narrow edge of the first surface jutting a short distance into the outlet of the gas nozzle. The edge of the second surface is set back from the edge of the first surface, such that a filming surface is defined on the first surface, adjacent the gas nozzle. Means are provided for directing a flowable liquid under pressure into the space between the first and second surfaces, so as to cause such liquid to flow between the abutting surfaces, toward the flow of propellant gas through said nozzle, and emit as a thin film along said edge of the second surface.

This emitted liquid flows onto the filming surface of the first surface, and the propellant gas, when flowing through the nozzle, is caused by the jutting edge of the first surface to separate slightly away from said narrow edge of the first surface at the location of the filming surface. Such slight gap or separation prevents the formation of a rolling wave or ridge of liquid on the filming surface, about the edge of the first surface, without inhibiting the flow of ribbons of such liquid from the filming surface into the propellant gas. The flow of the entrained liquid from the filming surface therefore takes the form of thin ribbons of liquid in the propellant gas flow, which ribbons of liquid break into shreds, which shreds collapse into particles of exceedingly small size.

Another aspect of inventions of this general nature involves the removal of relatively large liquid particles from a pneumatic atomizer's output, by directing the output at a target, such as a sphere, located on the centerline of the atomizer's output stream, a short distance downstream from the atomizer. The downstream gas flow must flow around such a target. The smaller liquid particles present in the flowing gas, which have a low momentum relative to their surface area, will flow with the gas around the target, whereas the larger liquid particles present in the gas, which particles have a high momentum relative to their surface area, are not able to flow around the target. The larger liquid particles thus collide with the target and wet the target. This liquid either runs off the target due to the influence of gravity as large droplets or, if the gas flow is sufficiently forceful, is blown off the target as unwanted large droplets. Therefore it is to be seen that one difficulty of using such a target to remove large liquid particles from a two fluid atomizer's output is the necessity of removing the runoff from the target (or from a sump under the target) created by the liquid particles that collide with the target.

In contrast with the use of a spherical target, in the instant Atomizer we use a target, hereinafter called a "pintle", of unique shape and design that effectively removes larger liquid particles from the Atomizer's output and re-atomizes the runoff back into the Atomizer's output.

We have found that the center of the gas orifice can be partially blocked without interfering with the operation of the instant Atomizer if we insert a device in the nature of an inverted cone into the center of the gas orifice, with the tip on the cone directed into the Atomizer, and the base of the cone directed out of the Atomizer. By moving the cone-shaped pintle inwardly and outwardly, it is possible for us to regulate the amount of gas passing through the gas orifice.

To further enhance the atomization it is possible to permit the large end of the pintle to stick out of the gas orifice. In such an instance the small particles of liquid in the fog generated at the outlet of the gas orifice tend to follow the gas currents that pass along and over the pintle. The large particles in the fog tend to impact on the pintle, where they coalesce onto a film of liquid on the pintle, which the gas currents then push to the large end of the pintle.

We utilize a short, thin, abrupt outward projection or lip with a sharp outer edge at the large end of the pintle. This sharp edged lip causes the gas flowing along and over the pintle to be deflected outwardly, thereby causing the envelope of the gas flow to not be in contact with the perimeter of the lip downstream of the lip's sharp edge. The liquid film that forms on the pintle, and is pushed to the large end of the pintle, becomes entrained into the deflected gas at the lip's sharp outer edge and is carried off the pintle by the deflected gas as small droplets.

It is thus to be seen that the principal object of the present invention is to provide an improved adjustable atomizer or pneumatic nebulizer used with low pressure propellant gas, that is capable of directly and uniformly generating an ultrafine stable fog of liquid particles, preferably having a maximum diameter of about 20 microns or less, and having an average diameter of 10 microns or less.

It is another object of this invention to provide an improved adjustable atomizer or pneumatic nebulizer that involves a nozzle used with filming surface jutting slightly into the throat of the nozzle, thus to form a sharp edged orifice responsible for the gas flow through the nozzle separating slightly from the innermost edge of the filming surface, to permit only very fine ribbons of liquid to be entrained from the filming surface.

It is yet another object of our invention to provide a sharp edged orifice responsible for achieving a highly desirable separation in the flow therethrough from the sides of the orifice, which orifice is ideally utilized with a converging nozzle.

It is still another object of our invention to provide an apparatus for generating an ultrafine fog of liquid particles in a propellant gas wherein the total weight of the liquid particles for a given weight of the propellant gas can be varied and controlled within close limits, independently of the pressure of the propellant gas.

It is yet still another object of the present invention is to provide a pneumatic nebulizer embodiment in which all the liquid supplied to the liquid orifice means is nebulized and dispersed as a stable fog, i.e. there is no liquid run-off and no drippage of liquid from the orifice means or from other parts of the nebulizer.

Still another object of the present invention is to provide a pneumatic nebulizer having a confined liquid supply whereby the nebulizer may be moved, tilted, inverted or vibrated during use without interrupting the supply of liquid to the propellant gas or interfering with the fog emission.

These and other objects, features and advantages of the present invention will become more apparent as the description proceeds.

DETAILED DESCRIPTION

Figure 1:
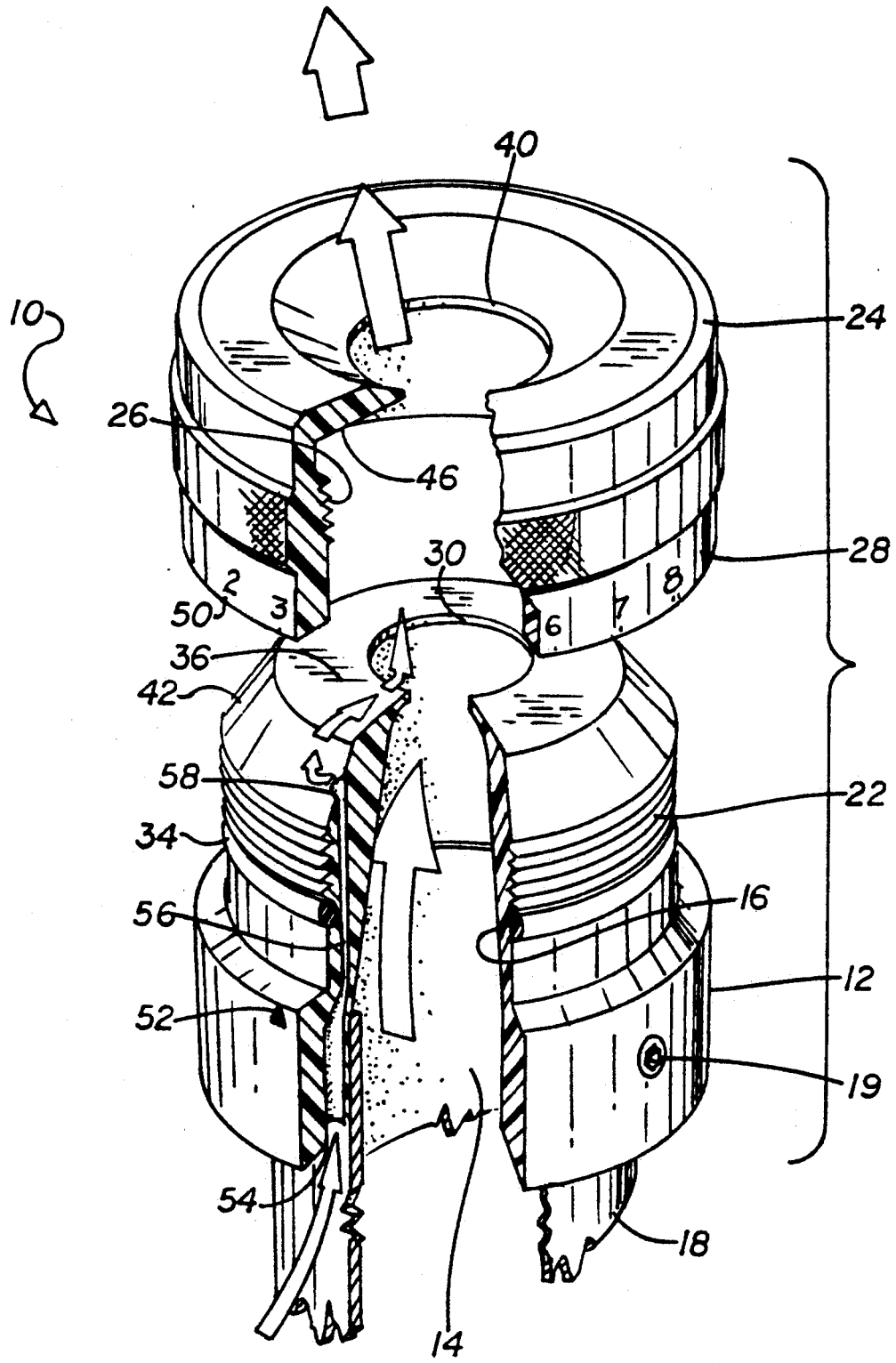
FIG. 1 is a view of a primary embodiment of our novel atomizer, partly in section to reveal internal construction, and with the cap removed to make it possible to view some of the important aspects of this embodiment of our invention.

With initial reference to FIG. 1, it will there be seen that we have revealed a first embodiment 10 of our invention, involving a body member 12 having an internal passage 14 therethrough. This internal passage 14 is configured to form a converging type nozzle 16 that accommodates the flow of air or some other suitable gas upwardly through the center of the member 12. An alternative to the utilization of a converging nozzle will be discussed hereinafter in conjunction with FIG. 6.

As revealed in FIG. 1, the body member 12 may be secured, for example, to a conduit or supply duct 18 through which air or another gas under relatively low pressure may be supplied to the converging nozzle 16 of the body member 12. The securing of the body member to the conduit or duct may be accomplished by the use of one or more lock screws 19.

Relatively fine external threads 22 encircle the upper exterior portion of the body member 12. These external threads 22 are designed to receive an internally threaded cap 24, whose internal threads 26 engage the threads 22 when the cap 24 is screwed onto the body 12. For reasons of clarity, the cap 24 is shown in exploded relation to the body member 12 in FIG. 1, and it will be noted that there is a central hole or aperture 40 in the cap 24 that is essentially in alignment with the internal passage 14 in the body 12, and the converging nozzle 16.

Figure 4:
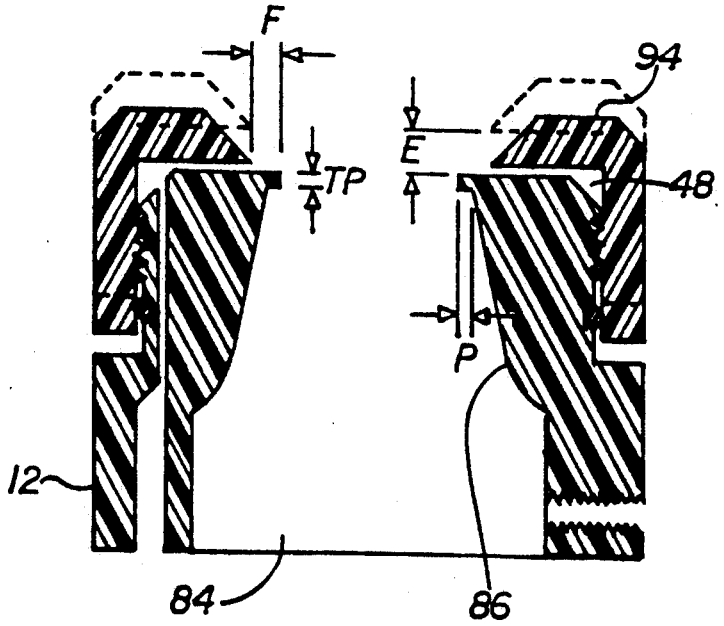
FIG. 4 is a cross-sectional view of a throat section that represents some of the most important details of a basic device in accordance with our invention.

An O-ring 34 is mounted in a suitable circumferential indentation on the body 12, to assure a fluid-tight seal between the body 12 and the cap 24. Note in FIG. 1 the preferable placement of the O-ring 34 below the threads 22, at a location in which it will be inside the skirt portion 28 of the cap 24. FIG. 4 should be noted in this regard, wherein the cap is shown in assembled relation on the body 12.

Returning to a further consideration of FIG. 1, it will be observed in connection with this embodiment of our invention that we provide a toroidally-shaped smooth surface 36 extending around the uppermost part of the body 12. In this preferred embodiment the smooth surface 36 extends entirely around the central orifice 30 in the body 12, and is flat. The smooth surface resides upon a small, abrupt small jut into the passage 14, and is perpendicular thereto. We may wish to refer to the orifice 30 as a sharp edge orifice.

Inasmuch as the smooth, symmetrically configured toroidally-shaped surface 36 is disposed on the body member 12, it may be regarded as a fixed surface, and it may also be identified hereinafter as the first surface. The relationship of the peripheral contour of the orifice 30 to the generally columnar flow of propellant gas therethrough will be discussed at length hereinafter.

From FIG. 1 it can also be seen that a steeply angled surface 42 extends entirely around the outer periphery of the toroidally-shaped surface 36, with the upper edge of the angled surface 42 terminating at the outer periphery of the flat toroidal surface 36, and the lower edge of the angled surface 42 terminating near the upper edge of the external threads 22.

Around the upper interior portion of the cap 24 is what we call the second smooth, toroidally-shaped surface 46, this latter surface being parallel to the first surface 36, and able to be brought into close contact therewith at such time as the cap 24 is screwed tightly onto the body member 12, with its threads 26 engaging the threads 22 on the body. Whereas in certain other figures we show the cap 24 in approximately the operative position on the body 12, for the purpose of clarity in explaining this invention, in FIG. 1 we show the first toroidally-shaped surface 36 and the second toroidally-shaped surface 46 in a spaced apart relationship. In reality, the surfaces 36 and 46 are in a very close, parallel relationship during operation of our device, typically spaced apart between 0.002 and 0.020 inches.

As will be explained at some length hereinafter, a radially inward flow of fluid takes place between the surfaces 36 and 46 when they have been brought closely together, so the fact that the distance between the surfaces can be precisely changed by careful rotation of the cap 24 with respect to the body 12 is one of the important aspects of this invention. We prefer to use threads on the inside surface of the cap 24 that are sufficiently fine that one-half turn of the cap 24 changes the spacing between the surfaces 36 and 46 by only 0.020 inches.

To aid the precise setting of the cap 24 with respect to the body 12, we provide calibrations 50 that in FIG. 1 are to be seen at carefully spaced locations around the skirt 28 of the cap 24, which calibrations are to be used in conjunction with a mark or reference point 52 placed at an appropriate location on the body 12. This arrangement makes it readily possible for the operator or user to closely control the extruding of a flowable liquid between the surfaces 36 and 46, toward the internal passage 14 through the body 12, where the column of propellant gas flowing through the converging nozzle 16 serves to pick up the tiny particles of the liquid on what we call the filming surface, described hereinafter.

Also to be noted in FIG. 1 is an inlet 54, disposed on the sidewall of the body member 12, by means of which the liquid to be injected or extruded into the gas flowing through the internal passage 14 can be admitted to the body 12. The inlet 54 is connected to an upwardly ascending passage 56 in the body 12, which passage terminates in an opening 58 located on the angled surface 42.

We configure the interior of the cap 24 to have an enlarged portion extending around the full inner circumference of the cap, and because of the creation of the angled surface 42 on the upper edge of the body 12, we have in effect created a plenum 48 (see FIG. 4) around the outer circumferential edges of the abutting parallel surfaces 36 and 46 in the embodiment revealed in FIG. 1.

We typically maintain the liquid pressure in plenum 48 on the order of 0.01 to 10 pounds per square inch, and as a result, the liquid is caused to be extruded between the closely spaced surfaces 36 and 46 at a rate determined by the tightness with which the cap 24 has been applied upon the body 12.

Figure 2:
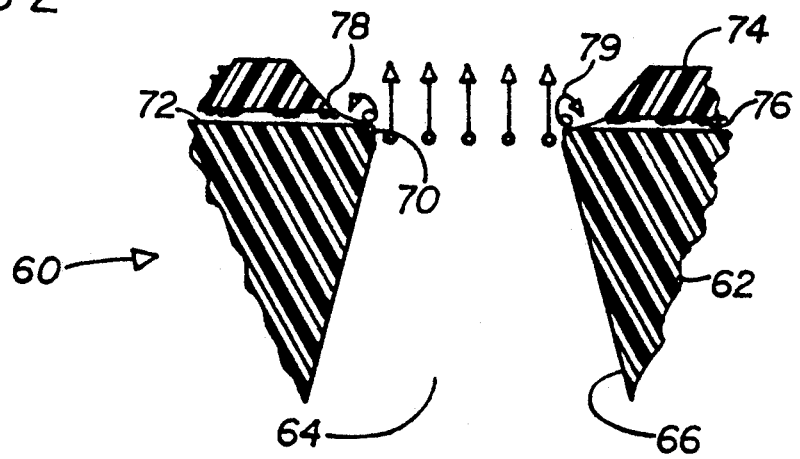
FIG. 2 is a cross sectional view of the throat portion of an illustrative device having inwardly tapering sidewalls, with the short arrows of approximately equal length being utilized to reveal the characteristics of the flow of air through the central orifice of such a device.

With reference now to the simplified showing of FIG. 2, it is to be noted that member 62 represents a fragmentary portion of a body member corresponding to body member 12 of FIG. 1. The member 62 has an internal passage 64 that becomes a converging nozzle 66, with aperture 70 being formed at the uppermost point of the body member 62. Formed atop the member 62 is a first toroidal surface 72.

Also in FIG. 2 it is to be noted that member 74 represents a fragmentary portion of a cap corresponding to cap 24 in FIG. 1. The member 74 has an undersurface 76 corresponding to the undersurface 46 of the cap 24. This may be regarded as the second toroidally shaped surface. In the middle of the member 74 is a central orifice or aperture 78, which is noticeably larger in diameter than the orifice 70. The series of vertically pointing arrows appearing in FIG. 2 may be regarded as representing the velocity and direction of the flowing gas. It should be noted that these arrows are all very nearly of identical length, for the outward gas flow is quite consistent across the orifice 70.

With continuing reference to FIG. 2, it is to be understood that the innermost portion of the toroidal surface 72 between aperture 78 in member 74 and aperture 70 in surface 72 is not covered by member 74. We may wish to refer to this non-covered surface as filming surface F.

It might well be assumed that by utilizing a gas supply conduit 64 of relative large cross-sectional area in FIG. 2, and directing the gas supply conduit into a smooth converging surface or nozzle 66 that has a downstream outlet 70 matching the shape and cross-sectional area of the orifice in the filming surface F, the liquid on the uncovered portion of the surface 72 would be entrained into gas flowing at a much higher velocity than the liquid experiences when the orifice in the filming surface forms a sharp edge with the upstream gas conduit. It might also have been assumed that as a consequence, the size of the output liquid particles should be smaller. Quite surprisingly, this is clearly not the case.

The output liquid particles resulting from the configuration depicted in FIG. 2 are not smaller, for the reason that the construction described in the last several paragraphs has a drastic counter-productive effect on the liquid film on the filming surface F that is depicted in FIG. 2.

If the vena contracta in the flowing gas is totally eliminated, that is, a sharp edge orifice is not utilized at the outlet of the gas nozzle, the gas flowing out of the orifice comes into contact with the liquid on surface 72 at the edge of aperture 70 and causes the liquid on the filming surface to form an undesirable rolling wave or ridge 79 on surface 72 around the perimeter of the orifice, as illustrated in FIG. 2. Inasmuch as the liquid is no longer a thin film at the edge of such an orifice, the liquid is entrained in the flowing gas in globs. The resulting particles, quite undesirably, are of large size.

Accordingly, in all embodiments of our invention, we use a configuration in which the orifice in the filming surface forms an abrupt small jut or projection into the outlet from the nozzle, or in other words, we are careful to utilize a sharp edge orifice in all embodiments of our invention. Thus, the embodiment depicted in FIG. 2 is not a usable configuration insofar as our invention is concerned.

Figure 3:
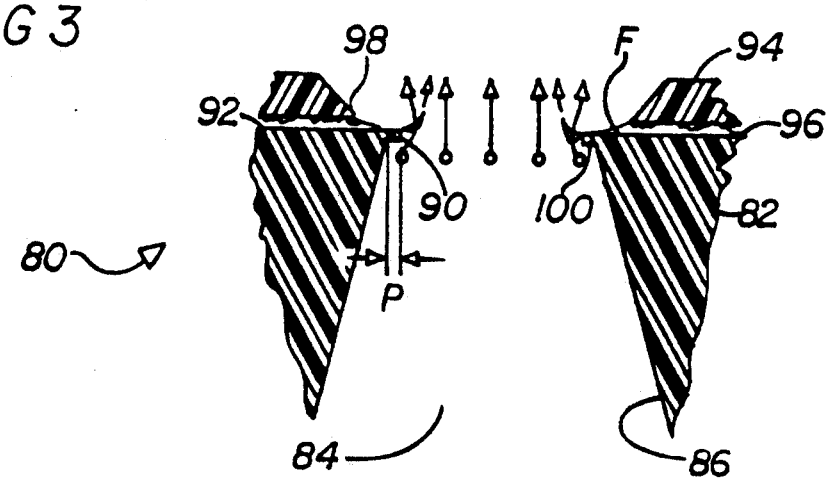
FIG. 3 is a simplified showing similar to FIG. 2, but here revealing the flow of air through a throat section of a device improved by the use of an inwardly extending shelf-like portion that is disposed around the periphery of the central orifice.

In FIG. 3 we show a preferred embodiment 80 involving a member 82 that represents a fragmentary portion of a body member corresponding to body member 12 of FIG. 1. The member 82 has an internal passage 84 that becomes a converging nozzle 86, with sharp edged orifice or aperture 90 being formed at the uppermost point of the body member 82, which may be regarded as the throat of the nozzle.

It is to be understood that the orifice 90 is smaller in diameter than the corresponding orifice 70 in the embodiment of FIG. 2, and as a matter of fact, the orifice 90 is located in a lip or projection 100 formed at the upper end or throat of the converging nozzle 86, extending for a short distance out into the column of gas flowing through the nozzle. The upper surface of the lip or projection is coincident with the first toroidal surface 92 formed atop the member 82, and the lower surface of the lip represents a small, abrupt projection into the outlet of the gas nozzle 86.

Also in FIG. 3 it is to be noted that member 94 represents a fragmentary portion of a cap corresponding to cap 24 in FIG. 1. The member 94 has an undersurface 96 corresponding to the undersurface 46 of the cap 24. This may be regarded as the second toroidally shaped surface. In the middle of the member 94 is a central orifice or aperture 98, which is noticeably larger in diameter than the orifice 90.

It is to be understood the uncovered surface 92 between aperture 98 in member 94 and aperture 90 in surface 92 is the filming surface F.

In this advantageous configuration depicted in FIG. 3, the velocity of the gas flowing near the perimeter of the outlet of the nozzle 86 will be almost identical to the velocity of the gas flowing through the center of the outlet of the nozzle, and because the outlet's output immediately flows through the sharp edge orifice 90 which projects a very short distance into the outlet of the nozzle, the velocity of the gas flowing near the perimeter of the orifice is almost identical to the velocity of the gas flowing through the center of the orifice.

The relatively short series of vertically pointing arrows appearing in FIG. 3 may be regarded as representing the velocity and direction of the flowing gas. It should be noted that these arrows are all very nearly the same length.

Quite advantageously, the provision of the sharp edge orifice 90 deflects the gas flow, as will be discussed at greater length hereinafter, but it does not to any consequential degree block the flow of gas through the orifice.

One of the important consequences of passing a fluid through a sharp edge orifice, with resulting deflection of the flowing gas, is the formation of a vena contracta. By definition, the cross-sectional area of the fluid's flow envelope will be less at the vena contracta than the cross-sectional area at the orifice, and also less than the area at a downstream location in the fluid's flow. Because of the foregoing, the fluid flowing through the sharp edged orifice 90 will desirably not come into contact with the sides of the orifice for some distance.

Applying the foregoing to the precisely adjustable atomizer in accordance with this invention, if the sides of the orifice are sufficiently short, that is, the thickness of lip 100 is sufficiently thin in the flow direction depicted in the embodiment of FIG. 3, the gas flowing through the orifice 90 will not be in contact with the edge of the orifice as the flow exits the downstream side of the orifice. Therefore, because the gas exiting the filming surface side of the orifice 90 is not in contact with the sides of the orifice, the gas does not come into contact with the liquid lying on the filming surface F. Rather, the only liquid the flowing gas comes into contact with is liquid that has left the filming surface F to become entrained in the flowing gas.

Because the column of gas flowing out of the orifice 90 does not come into direct, touching contact with the liquid on the filming surface, the flowing gas in the representation of our invention shown in FIG. 3 advantageously does not cause the liquid on the filming surface to form a rolling wave or ridge around the edge of the orifice, resembling the showing of FIG. 2, wherein the rolling wave or ridge 79 was depicted.

It is worthwhile to reemphasize in the instant atomizer depicted in FIG. 3, that the cross-sectional area and shape of the orifice 90 through the filming surface F is slightly smaller than the cross-sectional area and shape of the outlet of the converging nozzle 86, thereby forming the aforementioned lip or jut 100 that we regard as consequential to our invention.

As a result of this advantageous construction, the small projecting edge or lip 100 of the filming surface F creates a small, abrupt projection into the gas flow, thereby overcoming the "rolling liquid wave" problem appearing at 79 on the filming surface in FIG. 2, without significantly degrading the velocity of the gas flowing near the perimeter of the orifice through the filming surface. The favorable result is obtained provided the filming surface F is thin, and the edge projecting into the flowing gas is not more than a short projection into the column of flowing gas.

In FIGS. 3 and 4 we present components in which the central opening or orifice 90 in the center of toroidal surface 92 is somewhat smaller than the outlet of the duct or nozzle, thus forming a shelf-like member P that protrudes out into the converging nozzle 86. The orifice 90 in these two figures is obviously relatable to orifice 30 in FIG. 1.

On the upper or leeward side of the shelf-like member P is what we previously mentioned as being the filming surface F, which is the surface where an unencumbered flowable liquid is extruded out between the smooth, parallel surfaces 92 and 96, and allowed to naturally spread out or film out until it contacts the propellant gas flowing through the converging nozzle 86. Because of this arrangement, the liquid residing on the filming surface F is entrained into the propellant gas from a location just beyond the innermost edge of the shelf P. We may also wish to call this innermost edge the entrainment edge, and this point will be dealt with shortly in greater detail, in connection with FIG. 6.

Although it is an important aspect of our invention to make unnecessary, the utilization of a high pressure flow of gas in the internal passage 84 and the nozzle 86, we nevertheless find it desirable for the speed of the flow to be sufficient through passage 84 as to be able to entrain the liquid spread out on the filming surface F faster than this liquid is being extruded between the surfaces 92 and 96. In that way we effectively prevent the formation of particles of liquid that are undesirably large. We have found that if the filming surface F is too large, the cohesive force or affinity of the liquid to itself is such as to hinder distribution or filming of the liquid on surface F, so we must carefully establish the correct relationships of diameters of the apertures 90 and 98 so as to create a filming surface F of the appropriate size.

It is thus to be seen that it is critical for us to form a properly sized protruding shelf P around the circumference of the upper edge or throat of the duct or nozzle 86, with a properly sized filming surface being located approximately perpendicular to the flow of propellant gas in nozzle 86, and disposed on what we regard as the leeward side of the shelf. Because of this arrangement, upon the liquid to be nebulized being supplied to the filming surface F in a very thin layer from the location between the closely spaced toroidal surfaces 92 and 96, the propellant gas flowing at considerable speed through the nozzle 86 proceeds to entrain desirably thin ribbons of liquid into the gas, which break up into small liquid particles.

The speed of the air or other gas through the nozzle 86 is desirably so great past the entrainment edge of the filming surface F as to remove the liquid extruded between the surfaces 92 and 96 as fast as it is extruded, thereby causing the liquid to remain the extremely thin film extruded between these surfaces as the liquid flows across filming surface F.

We have found that the faster the speed of the gas past the filming surface, the smaller the resulting particles. Accordingly, we modulate the flow of the liquid extruded between the surfaces 92 and 96 to a minimal amount, with the sharp edged orifice jutting into the flow of propellant gas not blocking to any consequential degree, the flow of gas through the orifice. We maintain a propellant gas speed in the vicinity of approximately 200 miles per hour through the orifice, such that only very thin ribbons of the fluid are carried away from the filming surface F on the projection P.

With regard to FIG. 4, it will there be seen that we have utilized the reference character F to depict the filming surface; the character P to depict the amount or extent of the jut or projection; the character TP to depict the thickness of the projection; and the character E to depict possible movement of the cap. Actually, during usage of our device, the undersurface of the cap is always maintained very close to the upper surface of the body member, as hereinbefore mentioned.

Figure 5A:
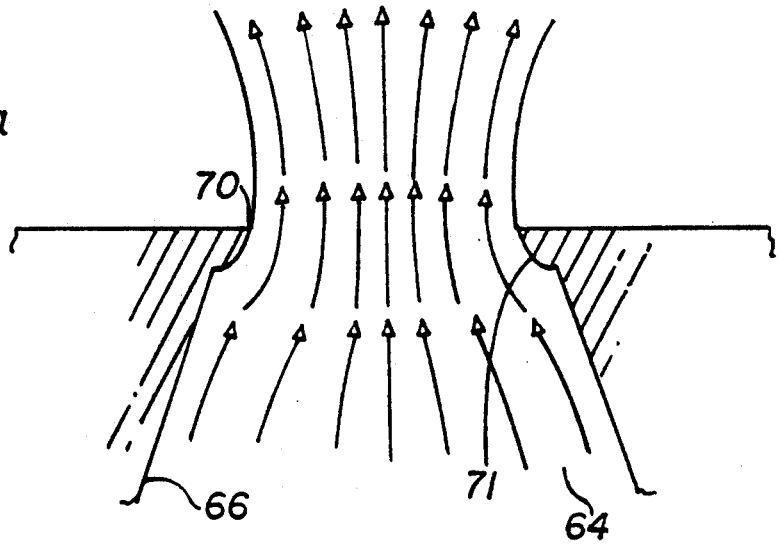
FIG. 5*a* is a cross-sectional view, to a larger scale, of the orifice portion of a device similar to that shown in FIG. 2, but with FIG. 5*a* revealing the deliberate use of a smooth contour at the location of the upper surface, upon which surface, liquid may be caused to flow.
Figure 5B:
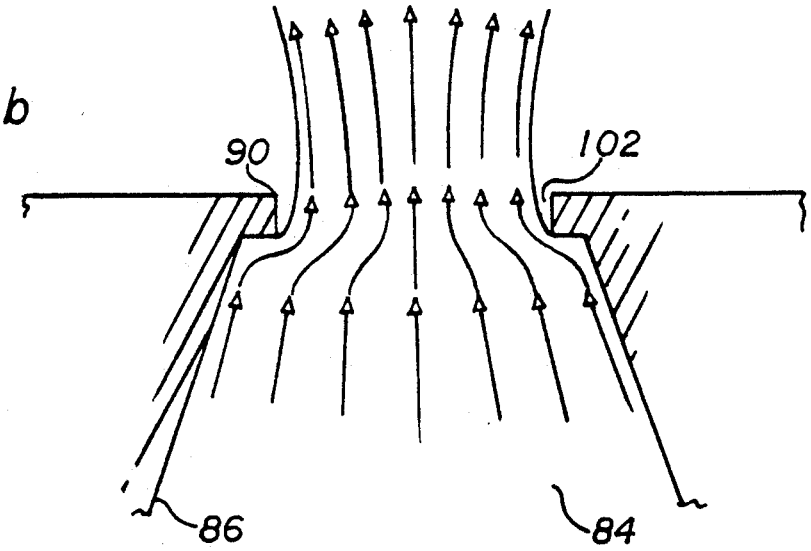
FIG. 5*b* is a cross-sectional view to the same large scale shown in FIG. 5*a*, but with FIG. 5*b* revealing the use in accordance with this invention of an abrupt jut or projection into the throat of the nozzle, with this jut or protuberance bringing about a distinct, highly desirable separation of the gas flow from the edge of the orifice.

Reference is now made to FIGS. 5*a* and 5*b* of the drawings, and it will be observed that FIG. 5*a* has a definite relationship with FIG. 2, and FIG. 5*b* has a definite relationship with FIG. 3. As will be noted, FIGS. 5*a* and 5*b* are shown to a slightly larger scale than the scale used in the execution of FIGS. 2 and 3, and it will also be noted that the reference numeral scheme associated with FIGS. 2 and 3 has been preserved in FIGS. 5*a* and 5*b*.

FIG. 5*a* may be regarded as representing an orifice 70 in which there is no jut or sharp edge projection into the column of gas that is flowing through the converging nozzle 66. Instead of a sharp edge orifice being utilized at this location, we show in FIG. 5*a* the internal passage 64 terminating in a smooth, circumferentially extending contour 71 at the location of the orifice 70.

It is most important to realize that the smooth contour 71 utilized in FIG. 5*a* is a configuration that permits the propellant gas flow to closely follow the contour, with no separation of the gas from the contour 71 taking place.

As mentioned hereinbefore in connection with FIG. 2 and 3, the utilization of a sharp edge orifice is a necessary ingredient of this invention, so it may be concluded that the configuration depicted in FIG. 5*a* represents an embodiment that is manifestly inoperative insofar as carrying forward the basic goals of our invention.

In contrast with FIG. 5*a*, we reveal in FIG. 5*b* to a comparatively large scale, the sharp edge orifice 90 in a desired relationship to the converging nozzle 66. It is very important to note that by virtue of our using a narrow edge first surface that juts a short distance into the outlet of the gas nozzle, the flow of propellant gas will be separate from the narrow (thin) edge of the first surface at the location of the filming surface F. This slight separation 102 is a hallmark of this aspect of our invention, and we have found that this slight separation does not prevent the entrainment of ribbons of fluid from the filming surface F. The separation depicted at 102 in FIG. 5*b* is simply not obtained when the smooth contour 71 depicted in FIG. 5*a* is utilized.

It is thus to be seen that three key attributes of the instant atomizer not possessed by the prior art are first, a nozzle defined by a smooth converging surface. This nozzle guides the flowing gas from a large cross-sectional area conduit to the underside of the filming surface, the outlet of the nozzle almost matching the shape and cross-sectional area of the orifice through the filming surface.

Secondly, a sharp edge orifice is utilized in the filming surface through which the flowing gas passes, which orifice is slightly smaller in cross-sectional area than the outlet of the nozzle.

Thirdly, a short gap or separation is created between the sharp edge of the orifice and the location where the flow of gas through the orifice comes into contact with the liquid entrained from the filming surface.

This invention is thus to be seen to be concerned with the structure in, at and about the outlet of the gas orifice in a gas/liquid nozzle designed to atomize a liquid into fine particles.

The essential aspects of this invention therefore involve (1) the feature of directing the gas through a smoothly converging sidewall that leads in a smooth transition to a gas outlet orifice, and (2) the feature of a small, abrupt restriction in the gas flow a short distance upstream of the outlet of the gas outlet orifice, the liquid to be atomized being introduced to the gas at the outlet of the gas outlet orifice. The foregoing features are produced by the combination of:

gas nozzle with converging sidewalls;

shelf or jut located at the outlet of the converging gas nozzle;

the shelf or jut projects but a short distance into the outlet of the converging gas nozzle;

the upstream edge of the shelf or jut is a sharp edge;

a filming surface on which liquid is spread as a thin film is located on the back (leeward) side of the shelf or jut; and the shelf or jut is sufficiently thin that the gas flowing out of the nozzle and past the shelf or jut is not in contact with the edge of the filming surface.

It is significant to note that the items delineated as (1) and (2) above are exact opposites, for item 1 calls for a smooth transition from the converging sidewalls of the gas conduit to the outlet orifice, whereas item (2) calls for there to be an abrupt restriction in the gas flow a short distance upstream of the outlet of the gas outlet orifice. The unexpected bringing about of cooperative action in a pneumatic atomizer from these two contrary features by means of the above-described combination is the source of the highly advantageous characteristics of the principal embodiment of this invention.

Figure 6:
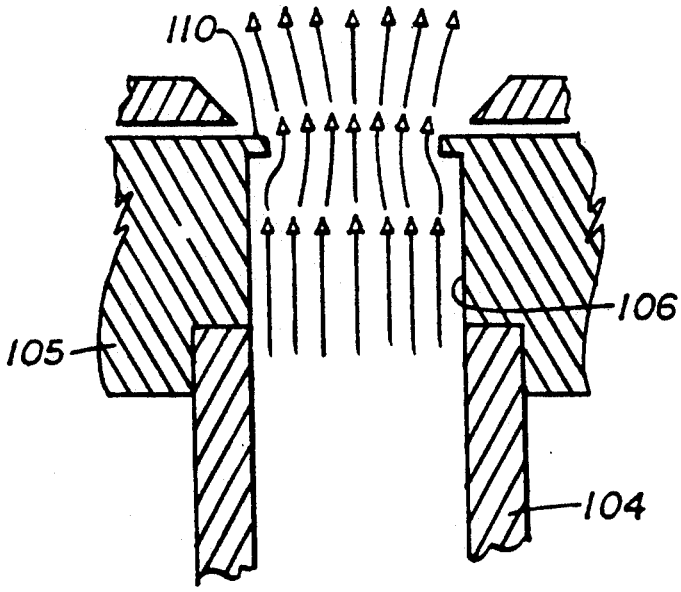
FIG. 6 is a cross-sectional view of an embodiment in which a straight-sided nozzle rather than a converging nozzle is used.

With reference now to FIG. 6, it will be noted that we have there shown a version of our invention in which a straight sided nozzle is utilized, as a secondary alternative to the use of a converging nozzle of the type discussed hereinbefore. In FIG. 6 it will be noted that we have provided a gas supply conduit 104, affixed to structural member 105, in which a straight sided nozzle 106 is contained.

A necessary ingredient of this embodiment of our invention is a jut or protrusion 110 along the lines of the jut or projection previously described, which of course is the component responsible for creating the flow separation discussed in conjunction with FIG. 5*b*. The secondary nozzle embodiment represented by FIG. 6 is not preferred over the converging nozzle except in limited circumstances, such as for use in a constricted space.

Figure 7:
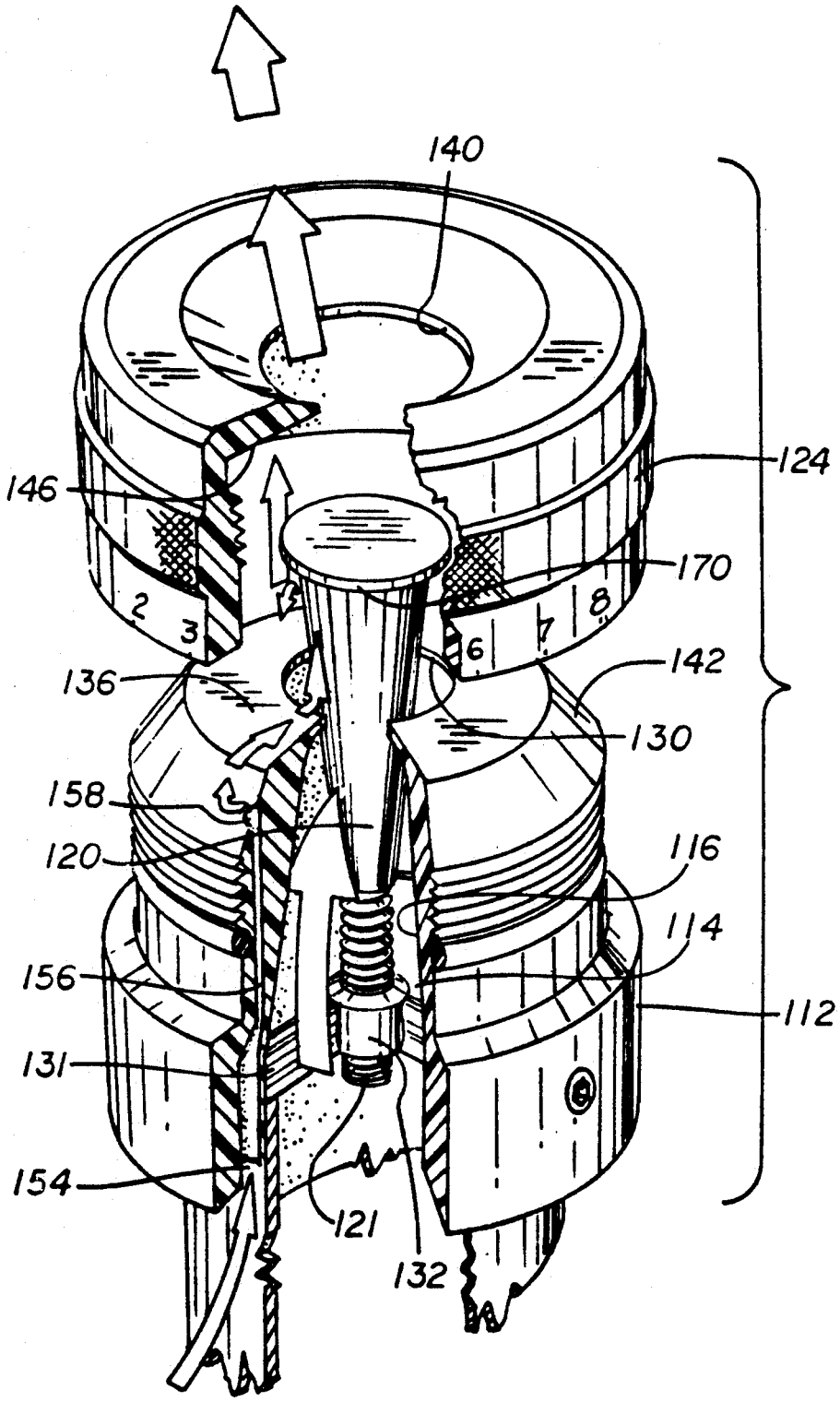
FIG. 7 is a view generally resembling FIG. 1 in that it is a view partly in section of one of our atomizers, with the cap removed and fragmented in order to reveal the novel adjustable pintle we utilize in this particular embodiment.

Another embodiment of our invention is depicted in FIG. 7, wherein we have depicted a body member 112 showing a distinct similarity to body member 12 in FIG. 1, which body member has a cap 124 having a distinct similarity to cap 24 in FIG. 1. By the similarity of the reference numerals we have used, other like comparisons can be readily made.

One distinct difference in the device of FIG. 7, however, is the use of the central member 120 or pintle supported in the center of body 112, and therefore in the center of the passage 114 and the converging nozzle 116 inside the body 112. This support of the pintle member 120 is brought about by the use of three or so legs 131 extending in a spoke-like manner from the internal sidewalls of the body 112, terminating in a hub 132, in the center of the passage 114. Some may prefer to call this a spider type support. The hub 132 is preferably internally threaded to receive the compatibly threaded lower end 121 of the central member 120. In that way the user or operator can vary the relationship of pintle or impactor 120 to the apertures 130 and 140. The important function of the pintle member 120 will be set forth at greater length hereinafter.

Also to be noted in FIG. 7 is an inlet 154, disposed on the sidewall of the body member 112, by means of which the liquid to be injected or extruded into the gas flowing through the internal passage 114 can be admitted to the body 112. The inlet 154 is connected to an upwardly ascending passage 156 in the body 112, which passage terminates in an opening 158 located on the angled surface 142.

Figure 8:
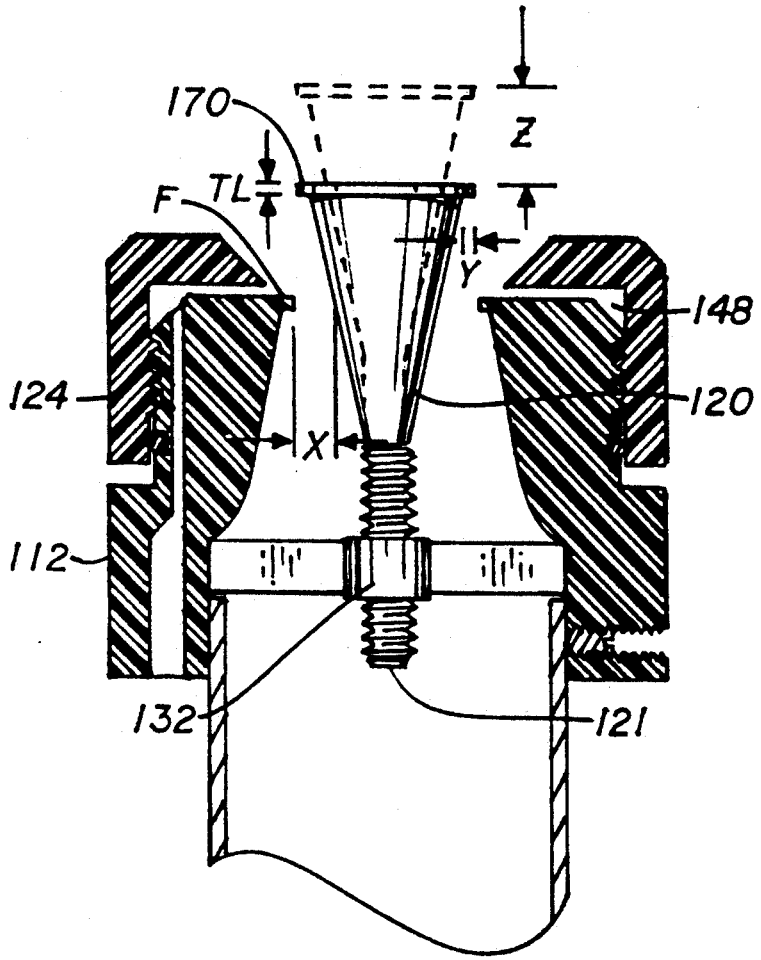
FIG. 8 is a cross-sectional view of the throat section of an embodiment in which an adjustable pintle in accordance with our invention is utilized.

We configure the interior of the cap 124 to have an enlarged portion extending around the full inner circumference of the cap, and because of the creation of the angled surface 142 on the upper edge of the body 112, we have in effect created a plenum 148 visible in accompanying FIG. 8, that is comparable to the plenum 48 depicted in FIG. 4. The plenum 148 is of course disposed around the outer circumferential edges of the abutting parallel surfaces 136 and 146 in the embodiment revealed in FIG. 7.

As previously mentioned, we typically maintain the liquid pressure in a plenum on the order of 0.1 to 10 pounds per square inch, and as a result, the liquid is caused to be extruded between the closely spaced surfaces 136 and 146 at a rate determined by the tightness with which the cap 124 has been applied upon the body 112

Figure 9:
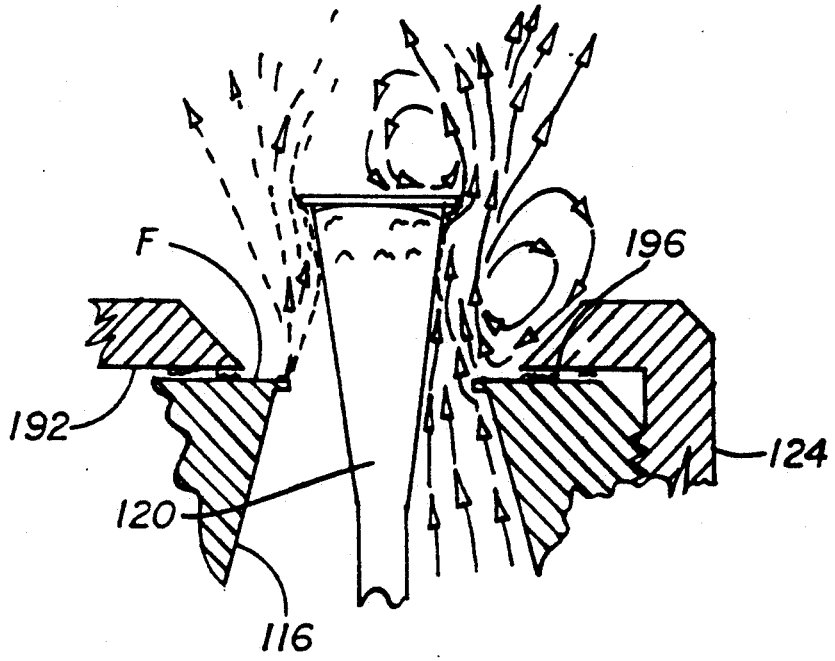
FIG. 9 is a fragmentary cross sectional view revealing the flow paths through the throat and around the upper portion of the pintle.

In FIGS. 8 and 9 we reveal other details of the configuration and utilization of the central member or pintle 120, and its relation to the other members of our novel device. The pintle is generally of inverted conical shape, with its downstream end larger than its upstream end. In FIG. 8 it will be noted that we have shown by the use of dashed lines, an example of movement of the pintle member 120 along its centerline. The movements of the pintle automatically in accordance with gas flow will be the subject of one of our later inventions.

As previously mentioned, threads 121 are provided on the lower end of the pintle, and as is obvious, we can establish the appropriate relationship of the pintle member to the gas flowing out of the orifices of this figure by screwing it in, or alternatively, by unscrewing it from its relationship to the hub member 132.

Also visible in FIG. 8 are several pairs of arrows, which are utilized to call out the preferable distance X between the orifice and the mid sidewall of the pintle 120; the distance Y representative of the lateral extent or width of the projection 170 disposed around the edge of the pintle; the distance TL representative of the thickness of the projection 170; and the distance Z representative of the pintle being movable along the centerline of the device.

It will be noted from FIG. 9 we have indicated that some particles of liquid impact upon the periphery of the pintle member 120, and upon the underside of the projection or abrupt, sharp edged lip 170 disposed around the upper or downstream edge of the member 120. Also shown in this figure are the flow paths of particles of liquid leaving the orifice of the device.

The effect of the pintle is to cause the larger particles to be captured and re-nebulized or reduced in size to a desirable extent.

The larger liquid particles leaving the orifice of the device impact on the surface of the pintle because their momentum to surface area ratio inhibits them following the gas flow around the pintle.

The liquid particles that impact on the conical surface of the pintle 120 merge together, forming a liquid film on this conical surface. The gas flowing out of the converging nozzle 116 flows upward along and over the conical surface of the pintle, toward the abrupt projection 170.

As will be observed from the series of arrows placed on FIG. 9, the gas flow is deflected radially outwardly by the abrupt projection 170, which flow of gas we find to be particularly advantageous.

The liquid that gathers on the conical surface of pintle 120 and at the underside of projection 170 is swept by the gas flowing along and over pintle 120 and the underside of projection 170 to the outer edge of the underside of the projection 170, where the liquid is entrained in the flowing gas as small ribbons of liquid in the outwardly deflected flowing gas, which ribbons break up into small particles.

It is to be noted that the impactor or pintle 120 is not needed in all applications and utilizations of our device, so for that reason it is desirable to construct it in the manner previously described, such that it can be unscrewed from the hub member 132 and entirely removed from the nozzle when the impactor is not needed.

Another reason for the threaded relationship between the lowermost end of the pintle member and the hub 132 is that the stem portion of the pintle member 120 is configured in such a way as to make it possible for the user to control and modulate the amount of air or other gas flowing through the passageway 114. Such control is accomplished either by rotating the pintle to constrict the effective aperture, accomplished by bringing the impactor closer to the orifices 130 and 140, or else by rotating the body member in the opposite direction, so as to further remove the impactor from the vicinity of the orifices, and to present less constriction to the flow of propellant gas through our device.

In FIG. 9 it will be observed that a gas eddy naturally occurs above filming surface F while our nozzle is in operation. Some of the small liquid particles in the nozzle's output will be in the eddy, and some of the liquid particles in the eddy will be thrown out of the eddy and against the upper surface of the cap 124.

Such particles on the cap merge and form a liquid film, which is swept toward the filming surface F by the gases flowing in the eddy. When the liquid film forming on the upper surface of the cap reaches the filming surface F, the liquid merges with the liquid extruded onto filming surface F from between closely spaced, parallel surfaces 192 and 196, thereby disposing of the liquid particles that the eddy above the cap has caused to be thrown against the upper surface of the cap.

As should be apparent from the foregoing, we have designed a very advantageous, low cost atomizer usable for a variety of applications, particularly in instances in which a high pressure gas supply is either not available or undesirable, and in which very small particle size is particularly desirable.

In creating an atomizer in accordance with the principles of this invention, we utilize the aforementioned abrupt jut or projection in the column of air flowing through the throat of the nozzle. This jut is comparatively thin in the direction of the gas flow, with the filming surface F being formed on the upper or leeward side of the abrupt jut.

The jut or projection serves to create what may be regarded as a sharp edge orifice, and we have found that the abrupt jut or projection into the column of gas need not be so great as to interfere with the flow of gas through the nozzle. As a matter of fact, increasing the extent of the jut into the column of gas beyond a minimally sufficient amount is largely unproductive.

The criterion we follow in establishing the amount of the jut or projection into the throat of the nozzle is that it be of just sufficient extent or dimension as to cause just sufficient separation of the flow, in the manner depicted at 102 in FIG. 5*b* of this case, to prevent the formation of a rolling wave or ridge or liquid at the edge of the filming surface.

We have found that for devices in accordance with this invention having a gas orifice with a diameter greater than approximately one-quarter inch through the filming surface, and with the sidewall or edge thickness of the orifice being less than approximately 0.50 inch, the jut or projection should extend a short distance into the flowing column of gas, usually not less than 0.050 inch and not more than 0.150 inch, and preferably should extend approximately 0.090 inch into the column of gas.

Although the devices in accordance with this invention that are depicted in the drawings are shown as components in which the filming surface circumscribes the column of gas flowing through the device, and such is the preferred embodiment, it is nevertheless to be understood that devices in accordance with the scope and spirit of this invention could include those in which the filming surface borders only a portion of the column of gas flowing through the device. For example, the propellant gas could be encased by a rectangular duct, with the filming surface located on only one side or sector of the duct, or with filming surfaces located on opposite sides or sectors of the duct.

We claim:

1. A nebulizer device capable of reducing a flowable liquid to an ultrafine dispersion of liquid particles in a propellant gas, said device comprising a mixing element having first and second members, said members being generally of toroidal configuration and having smooth, closely spaced surfaces, each surface having an edge adjacent which a column of gas can flow in a substantially perpendicular relationship through said members, such column of gas first flowing through a gas nozzle defined by smooth converging sidewalls that terminate at said first member, said converging sidewalls being of sufficient length that the gas flowing through said nozzle exits the nozzle with a substantially uniform velocity, said gas thereafater flowing adjacent the edge of said second member, the edge of said first member projecting a short distance into such column of gas at the exit of said gas nozzle, the edge of said second member being further distant from the center of such column of gas than the edge of said first member, such that a filming surface is defined on a portion of said first member that can be regarded as projecting a short distance into the column of gas, means for applying a flowable liquid under pressure between said members, so as to cause such flowable liquid to pass along between said smooth, closely spaced surfaces and emit as a film of liquid on said filming surface, the gas flow causing such liquid film to be entrained therein as a dispersion of ultrafine liquid particles.

2. The nebulizer device capable of reducing a flowable liquid to an ultrafine dispersion of liquid particles in a propellant gas as recited in claim 1 in which said edge of said first member extends into the column of gas at the exit of said gas nozzle for a distance in the range of 0.050" to 0.150.

3. The nebulizer device capable of reducing a flowable liquid to an ultrafine dispersion of liquid particles in a propellant gas as recited in claim 1 in which the upstream edge of the edge of said first member that extends into the column of gas is a sharp edge.

4. The nebulizer device capable of reducing a flowable liquid to an ultrafine dispersion of liquid particles in a propellant gas as recited in claim 1 in which a vena contracta is created in the propellant gas flow, at a location approximately at the level of said filming surface.

5. The nebulizer device capable of reducing a flowable liquid to an ultrafine dispersion of liquid particles in propellant gas as recited in claim 1 in which one of said surfaces is fixed, and the other is movable with respect thereto.

6. The nebulizer device capable of reducing a flowable liquid to an ultrafine dispersion of liquid particles in a propellant gas as recited in claim 1 in which the edge of the projection of the first surface into the gas flow is in an approximately right angle relationship with the underside of the projection.

7. An atomizer device capable of reducing a flowable liquid to an ultrafine dispersion of liquid particles in a propellant gas, said device comprising a body member having a gas nozzle defined by smooth converging sidewalls, said converging sidewalls being of sufficient length that the gas flowing through said nozzle exits the nozzle with a substantially uniform velocity, said sidewalls terminating at a first of two superposed smooth surfaces, the first smooth surface being disposed in a substantially perpendicular relationship to said nozzle, the second smooth surface being disposed in an abutting parallel relationship with said first smooth surface, with a very small spacing existing between said first and second surfaces, an edge of said surfaces being disposed adjacent the propellant gas flowing through said gas nozzle, and with the edge of said first surface being thin and jutting a short distance into the outlet of said gas nozzle, the edge of said second surface being set back from the edge of said first surface, such that a filming surface is defined on said first surface, adjacent the edge of said first surface, means directing a flowable liquid under pressure into the space between said abutting surfaces, so as to cause such liquid to flow between said abutting surfaces, toward the flow of propellant gas through said nozzle, and emit as a thin film along said edge of said second surface, and onto said filming surface of said first surface, such propellant gas, when flowing through said nozzle, being caused by said jutting edge of said first surface to be slightly separated from said thin edge of said first surface at the location of said filming surface, such slight separation not preventing the entrainment into the propellant gas of ribbons of such liquid from said filming surface, the entrained liquid breaking up into extremely small particles in the propellant gas flow.

8. The atomizer device capable of reducing a flowable liquid to an ultrafine dispersion of liquid particles in a propellant gas as recited in claim 7 in which the short distance said edge of said first surface juts into the outlet of the gas nozzle is in the range of 0.050" to 0.150".

9. The atomizer device capable of reducing a flowable liquid to an ultrafine dispersion of liquid particles in a propellant gas as recited in claim 7 in which a vena contracta is created in the propellant gas flow, at a location approximately at the level of said filming surface.

10. The atomizer device capable of reducing a flowable liquid to an ultrafine dispersion of liquid particles in a propellant gas as recited in claim 7 in which one of said surfaces is fixed, and the other is movable with respect thereto.

11. The atomizer device capable of reducing a flowable liquid to an ultrafine dispersion of liquid particles in a propellant gas as recited in claim 7 in which the thin edge of the first surface is .in an approximately right angle relationship with the underside of the projection into the gas flow.

12. An atomizer device capable of reducing a flowable liquid to an ultrafine dispersion of liquid particles in a propellant gas, said device comprising a body member having a gas nozzle defined by smooth converging sidewalls that terminate at a first of two superposed smooth surfaces, said converging sidewalls being of sufficient length that the gas flowing through said nozzle exits the nozzle with a substantially uniform velocity, the first smooth surface being disposed in a substantially perpendicular relationship to said nozzle, the second smooth surface being disposed in an abutting parallel relationship with said first smooth surface, with a very small spacing existing between said first and second surfaces, an orifice in each of said surfaces circumscribing the propellant gas exiting said nozzle, the first said surface having an edge jutting a short distance into the outlet of said gas nozzle, said edge being thin and having an approximately right angle relationship with the underside of said first surface, the orifice in the second of said surfaces being set back from the orifice in the first of said surfaces, such that a filming surface is defined on said first surface adjacent said edge of said first surface, means directing a flowable liquid under pressure into the space between the said first and second surfaces, so as to cause such liquid to flow between said abutting surfaces, toward the flow of propellant gas through said orifices, and emit as a thin film along the edge of said orifice in said second surface, and onto said filming surface located on said first surface, such propellant gas, when flowing through said nozzle, being caused by said jutting edge of said first surface to be slightly separated from said thin edge of said orifice in said first surface at the location of said filming surface, such slight separation not preventing the entrainment into the propellant gas of ribbons of such liquid from said filming surface, the entrained liquid breaking up into extremely small particles in the propellant gas flow.

13. The atomizer device capable of reducing a flowable liquid to an ultrafine dispersion of liquid particles in a propellant gas as recited in claim 12 in which said short distance of said jutting edge is in the range of 0.050" to 0.150".

14. The atomizer device capable of reducing a flowable liquid to an ultrafine dispersion of liquid particles in a propellant gas as recited in claim 12 in which a vena contracta is created in the propellant gas flow, at a location approximately at the level of said filming surface.

15. The atomizer device capable of reducing a flowable liquid to an ultrafine dispersion of liquid particles in a propellant gas as recited in claim 12 in which one of said surfaces is fixed, and the other is movable with respect thereto.

* * * * *